US007576759B2

(12) United States Patent
Pettitt et al.

(10) Patent No.: US 7,576,759 B2
(45) Date of Patent: Aug. 18, 2009

(54) PARALLEL DITHERING CONTOUR MITIGATION

(75) Inventors: Gregory S. Pettitt, Rowlett, TX (US); Bradley W. Walker, Dallas, TX (US); Matthew John Fritz, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 829 days.

(21) Appl. No.: 10/914,915

(22) Filed: Aug. 10, 2004

(65) Prior Publication Data

US 2005/0052703 A1 Mar. 10, 2005

Related U.S. Application Data

(62) Division of application No. 09/795,403, filed on Feb. 26, 2001, now Pat. No. 6,774,916.

(60) Provisional application No. 60/184,751, filed on Feb. 24, 2000.

(51) Int. Cl.
*G09G 5/10* (2006.01)

(52) U.S. Cl. ..... 345/691; 345/692; 345/690

(58) Field of Classification Search ..... 345/204, 345/209, 418, 660, 555, 601, 84, 690–692, 345/598, 561; 358/3.1, 1.9, 2.1, 466, 3.26, 358/539, 448, 538, 1.15, 486; 348/14.13, 348/580, 452, 231.7, 608, 470, 473, 739, 348/459, 448, 441; 382/104, 165, 190, 232, 382/197, 236

See application file for complete search history.

(56) References Cited

U.S. PATENT DOCUMENTS 4,205,389 A * 5/1980 Heartz ..... 345/561
4,463,372 A * 7/1984 Bennett et al. ..... 348/580
4,472,732 A * 9/1984 Bennett et al. ..... 348/452
4,493,105 A * 1/1985 Beall et al. ..... 382/197
4,627,004 A * 12/1986 Cool et al. ..... 358/1.9
4,734,782 A * 3/1988 Maeshima ..... 358/466
4,987,496 A * 1/1991 Greivenkamp, Jr. ..... 358/448
5,164,831 A * 11/1992 Kuchta et al. ..... 348/231.7
5,463,720 A * 10/1995 Granger ..... 358/1.9
5,539,452 A * 7/1996 Bush et al. ..... 348/14.13
5,616,228 A 4/1997 Nasu et al.
5,625,759 A * 4/1997 Freeman ..... 358/1.15

(Continued)

OTHER PUBLICATIONS

U.S. Appl. No. 09/088,674, filed Jun. 2, 1998, Morgan et al.

(Continued)

*Primary Examiner*—Prabodh M. Dharia
(74) *Attorney, Agent, or Firm*—Charles A. Brill; Wade James Brady, III; Frederick J. Telecky, Jr.

(57) ABSTRACT

A method of producing an image. Image data word comprising image data bits for a portion of the image is received at a first frame rate. At least two threshold data values are selected. A first portion of the image data word is compared with the threshold data values. A second portion of said image data word is displayed at a frame rate at least two times said first frame rate. Image data based on the comparison between the first portion of the image data word and the threshold data values is displayed at a frame rate at least two times the first frame rate.

10 Claims, 3 Drawing Sheets

U.S. PATENT DOCUMENTS 5,896,176 A * 4/1999 Das et al. ..... 375/240.15
5,917,950 A * 6/1999 Yim ..... 382/236
6,097,368 A * 8/2000 Zhu et al. ..... 345/601
6,151,075 A * 11/2000 Shin et al. ..... 348/459
6,252,989 B1 * 6/2001 Geisler et al. ..... 382/232
6,281,873 B1 * 8/2001 Oakley ..... 345/418
6,310,591 B1 * 10/2001 Morgan et al. ..... 345/84
6,324,006 B1 11/2001 Morgan
6,326,999 B1 * 12/2001 Wise ..... 348/441
6,480,300 B1 * 11/2002 Aoyama ..... 358/1.9
6,625,315 B2 * 9/2003 Laumeyer et al. ..... 382/190
6,894,726 B2 * 5/2005 Carlsgaard et al. ..... 348/448
6,927,877 B2 * 8/2005 Kanno et al. ..... 358/3.1
6,943,920 B2 * 9/2005 Edgar ..... 358/3.26
7,142,203 B2 * 11/2006 Hiroki et al. ..... 345/209
7,446,785 B1 * 11/2008 Hewlett et al. ..... 345/691
2001/0017631 A1 * 8/2001 Oakley ..... 345/660
2002/0005913 A1 * 1/2002 Morgan et al. ..... 348/739
2003/0058229 A1 * 3/2003 Kawabe et al. ..... 345/204
2003/0156301 A1 * 8/2003 Kempf et al. ..... 358/486
2003/0161006 A1 * 8/2003 Kobayashi et al. ..... 358/2.1
2005/0036173 A1 * 2/2005 Hayashi et al. ..... 358/2.1
2006/0197776 A1 * 9/2006 Morgan et al. ..... 345/598

OTHER PUBLICATIONS

U.S. Appl. No. 09/573,109, filed May 17, 2000, Morgan.

* cited by examiner

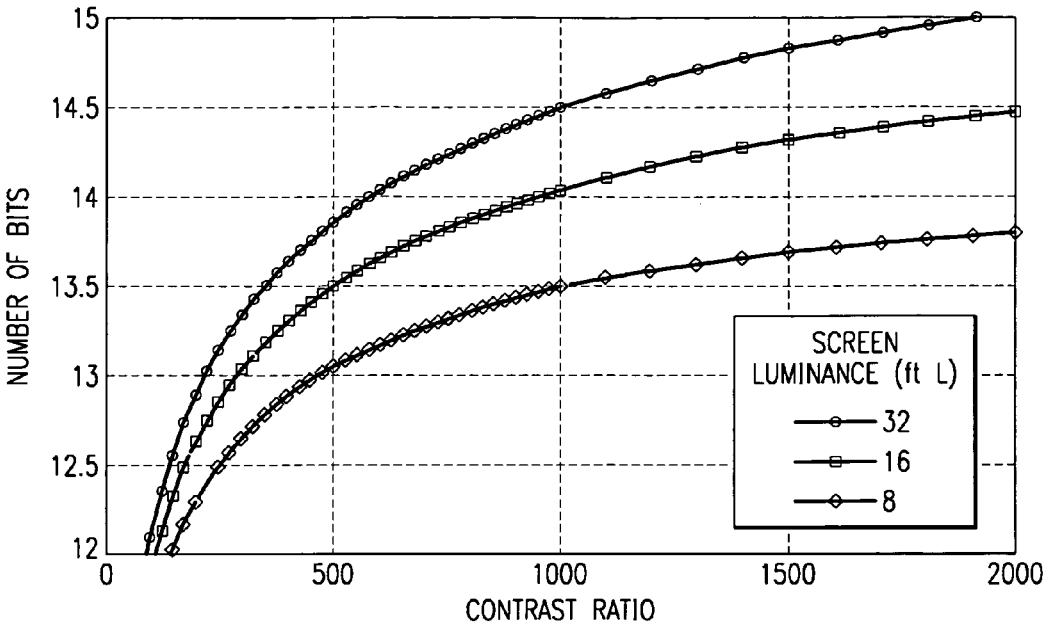
FIG. 1
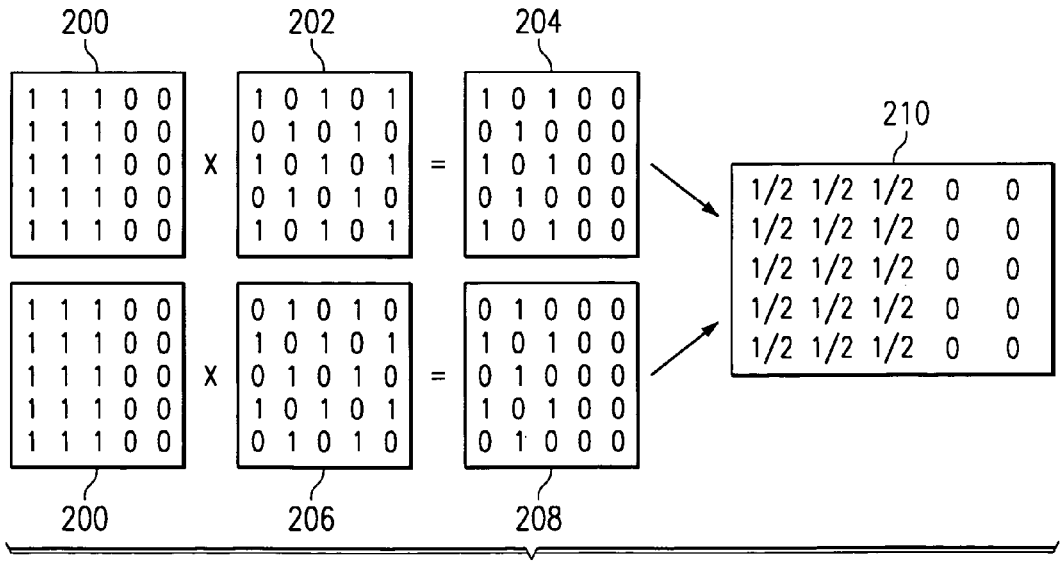
FIG. 2
(PRIOR ART)
300
| | | | |
|---|---|---|---|
| 9 | 1 | 12 | 8 |
| 11 | 6 | 3 | 15 |
| 0 | 4 | 14 | 13 |
| 7 | 10 | 2 | 5 |
FIG. 3

402
| | | | | | | | |
|---|---|---|---|---|---|---|---|
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
→
404
| | | | | | | | |
|---|---|---|---|---|---|---|---|
| 1 | 1 | 0 | 1 | 0 | 1 | 0 | 0 |
| 1 | 1 | 1 | 0 | 0 | 0 | 0 | 0 |
| 1 | 1 | 0 | 0 | 1 | 1 | 0 | 0 |
| 1 | 1 | 1 | 1 | 0 | 0 | 1 | 0 |
| 1 | 1 | 0 | 1 | 0 | 1 | 0 | 0 |
| 1 | 1 | 1 | 0 | 0 | 0 | 0 | 0 |
| 1 | 1 | 0 | 0 | 1 | 1 | 0 | 0 |
| 1 | 1 | 1 | 1 | 0 | 0 | 1 | 0 |
*FIG. 4*
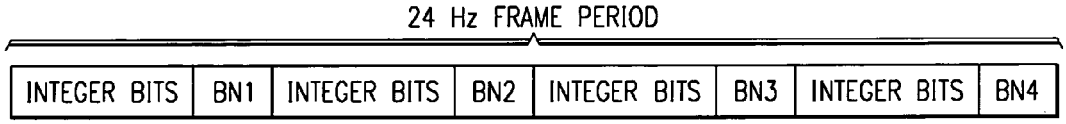
*FIG. 5*
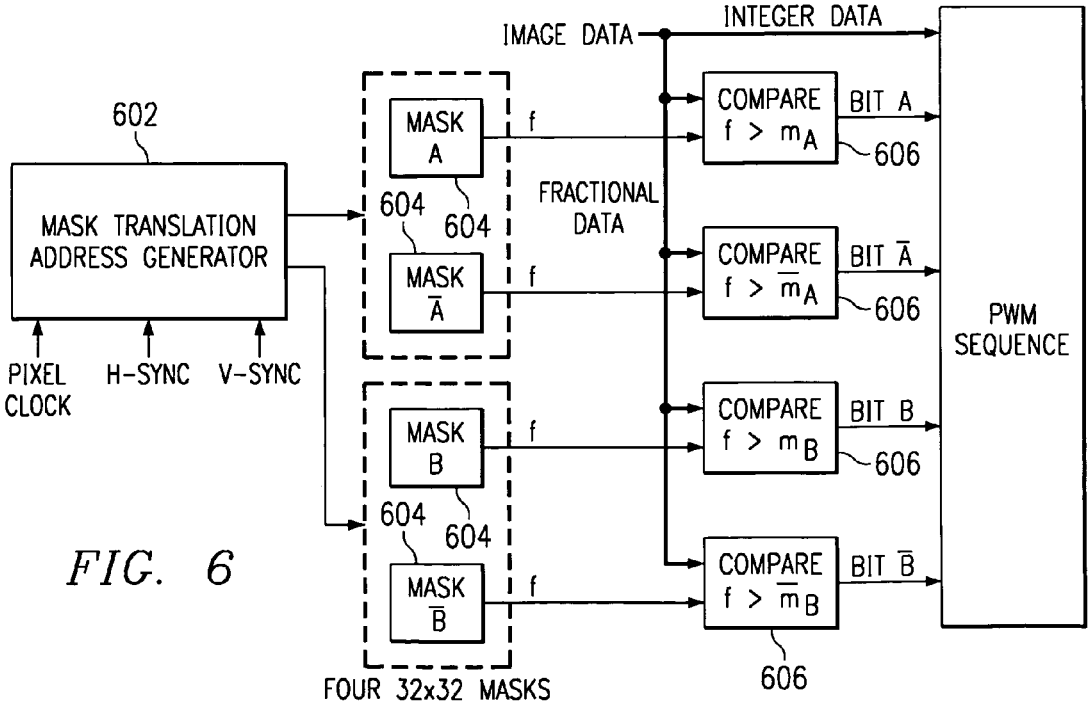
*FIG. 6*

PARALLEL DITHERING CONTOUR MITIGATION

This application is a Divisional of application Ser. No. 09/795,403, filed 26 Feb. 2001, now U.S. Pat. No. 6,774,916, and Provisional Application No. 60/184,751 filed Feb. 24, 2000.

CROSS-REFERENCE TO RELATED APPLICATIONS

The following patents and/or commonly assigned patent applications are hereby incorporated herein by reference:

| Patent. No. | Filing Date | Issue Date | Title |
|---|---|---|---|
| 5,616,228 | Jun. 5, 1996 | Apr. 8, 1997 | Method For Reducing Temporal Artifacts in Digital Video |
| 09/088,674 | Jun. 2, 1998 | | Boundary Dispersion For Mitigating PWM Temporal Contouring Artifacts In Digital Displays |
| 09/572,470 | May 17, 2000 | | Spoke Light Recapture In Sequential Color Imaging Systems |
| 09/573,109 | May 17, 2000 | | Mitigation Of Temporal PWM Artifacts |
| 09/795,402 | Feb. 26, 2001 | | Blue Noise Spatial Temporal Multiplexing |

FIELD OF THE INVENTION

This invention relates to the field of display systems, more particularly to digital display systems using pulse width modulation.

BACKGROUND OF THE INVENTION

Digital display systems typically produce or modulate light as a linear function of input image data for each pixel. For an 8-bit monochromatic image data word, the input image data word ranges from 0 to 255. A value of 0 results in no light being transmitted to or produced by a pixel, 255 is the maximum intensity level for a pixel, and 128 is mid-scale light.

Pulse width modulation (PWM) schemes typically modulate a constant intensity light source in periods whose length increases by a power of two. For example, when 5 mS is available for each color of a three-color system the element on times for one 8-bit system are 20 μS, 40 μS, 80 μS, 160 μS, 320 μS, 640 μS, 1280 μS, and 2560 μS. If a given bit for a particular pixel is a logic 0, no light is transmitted to or generated by the pixel. If the bit is a logic 1, then the maximum amount of light is transmitted to or generated by the pixel during the bit period. The viewer's eye integrates the light received by a particular pixel during an entire frame period to produce the perception of an intermediate intensity level.

By their nature, PWM systems produce discrete intensity levels. One problem encountered by PWM display systems is the difficulty in creating very small intensity resolution steps. As the contrast ratio of the display system increases, it becomes much more important to create very small steps between intensity levels. While a one least significant bit (LSB) intensity step is not generally objectionable when the image being displayed is very bright, it can be very objectionable in a dim region of an image.

Unfortunately, the LSB intensity step size cannot be made arbitrarily small. Image data for each bit period must be loaded into each pixel of the display device. Very small LSB periods are limited by the amount of data that can be loaded during the frame period or portion thereof. Additionally, the display device itself has some finite response time. For example, digital micromirror devices require not only a certain amount of time to load the memory array underlying the mirror array, but also a finite amount of time to reset the mirrors and allow them to transition from one position to the next.

Another problem encountered by PWM display systems is the creation of visual artifacts that arise due to the generation of an image as a series of discrete bursts of light. While stationary viewers perceive stationary objects as having the correct intensity, motion of the viewer's eye or motion in the image can create an artifact know as PWM temporal contouring. PWM temporal artifacts are described in U.S. Pat. No. 5,619,228. PWM temporal artifacts are created when the distribution of radiant energy is not constant over an entire frame period and may be noticeable when there is motion in a scene or when the eye moves across a scene.

When the eye moves across a scene, a given point on the retina of the eye accumulates light from more than one image pixel during the eye's integration period. If the various pixels are all displaying the same intensity in the same way—the discrete bursts of light are occurring simultaneously for all pixels—the perceived pixel intensity will be correct. If the various pixels are not displaying the same intensity in the same way the eye may falsely detect bright flashes. This happens when the discrete bright periods of a first pixel are created during a first portion of the frame period and the eye then scans to a second pixel that uses the next portion of the frame period to display the light. Since the same point on the retina receives the light from the first pixel and the second pixel in rapid succession—less than the decay period of the eye—that point of the retina perceives a single pixel as bright as the sum of the first and second pixels. This PWM temporal contouring artifact appears as a noticeable pulsation in the image pixels. This pulsation is time-varying and creates apparent contours in an image that do not exist in the input image data.

PWM temporal contouring is most clearly seen when viewing a grayscale ramp that increases horizontally across an image. As the image data on each line increase from 0 on the left of the row to 255 on the right, there are several places along each row where the major bits change from a logic 0 to a logic 1. The most dramatic change is in the center of each row where one pixel has a binary value of 127, which results in the first seven bits being a logic 1, and the adjacent pixel to the right having a binary value of 128, which results in the first seven bits being a logic 0 and the most significant bit being a logic 1.

If the image data is displayed over time in order of decreasing bit magnitude, that is b7, b6, b5, b4, b3, b2, b1, and b0, a viewer scanning from left to right may see an abnormally bright region at the 127 to 128 transition. This abnormal brightness is due to the viewer's eye integrating the last half of a given frame of pixel data 127—during which all bits 6:0 are all on—with the first half of the next frame—during which bit 7 is on for the entire half-frame. The net effect of the integration of the last half of the 127-valued pixel and the first half of the 128-valued pixel is a pixel having an intensity value of 255. The same artifact occurs when the pixel data is moving and the viewer's eye is stationary, and at the lower bit transitions.

When viewed at a normal viewing distance, the PWM contouring artifact created by two adjacent pixels is very difficult, if not impossible, for the typical viewer to detect. In real images, however, the bit transitions often occur in areas having a large number of adjacent pixels with virtually identical image data values. If these large areas of similar pixels have clusters whose intensity values cross a major bit transition, the PWM contouring is much easier to detect.

One method of reducing the PWM temporal contouring artifact uses bit splitting. Bit splitting divides the long periods during which the more significant bits are displayed into two or more shorter bits and distributes them throughout the frame period. For example, an 8-bit system may divide the MSB, having a duration of 128 LSB periods, into four equal periods each requiring 32 LSB periods and distributed throughout the frame period.

Bit splitting techniques reduce most of the objectionable PWM temporal artifacts. Unfortunately, bit splitting increases the necessary bandwidth of the modulator input since some of the data must be loaded into the system multiple times during a single frame period.

Given the quantization and temporal artifacts created by PWM displays, a method and system of producing very small intensity changes and eliminating noticeable temporal artifacts is needed. The method and system ideally will provide very small intensity changes without requiring the very short bit durations that are difficult to reproduce using micromechanical spatial light modulators.

SUMMARY OF THE INVENTION

Objects and advantages will be obvious, and will in part appear hereinafter and will be accomplished by the present invention which provides a method and system for contour mitigation using a blue noise dithering system. One embodiment of the claimed invention provides a method of producing a pulse width modulated image. The method comprising: receiving at least three bits of pixel data for each pixel in the image; and, for each pixel in the image: dividing the pixel data into at least one integer bit and at least two fractional bits; indexing a three dimensional mask to obtain a threshold value for each pixel; selectively enabling the pixel for a period corresponding to the significance of each of the integer bits depending on the logic level of each integer bit; and selectively enabling the pixel for a blue noise period depending on the relative magnitude of the threshold value and the fractional bits.

According to another embodiment of the present invention, a display system is provided. The display system uses PWM techniques to display digital pixel data for a period proportional to the significance of a particular bit of pixel data. A group of fractional data bits are compared to threshold value provided by a three dimensional mask. The three dimensional mask represents a two dimensional array of pixels and holds threshold value that is allowed to assume one of more than two values. The result of the comparison between the fractional bits and the threshold is displayed for a period appropriate to the maximum value of the fractional bits.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is a plot showing the number of bits needed for contour mitigation for a variety of screen luminance levels over a range of contrast ratios.

FIG. 2 is a diagram showing the operation of spatial temporal multiplexing used in the prior art.

FIG. 3 is a simplified blue noise mask for a 4×4 pixel array.

FIG. 4 is a diagram showing a input data for an 8×8 pixel array and the resulting 8×8 bit plane after the input data has been masked by the multi-level mask of FIG. 3.

FIG. 5 is a timeline showing the use of four blue noise periods in each frame period.

FIG. 6 is a block diagram of the signal processing used to implement one embodiment of the present invention having multi-level masking.

DETAILED DESCRIPTION OF THE PREFERRED EMBODIMENTS

Figure 7:
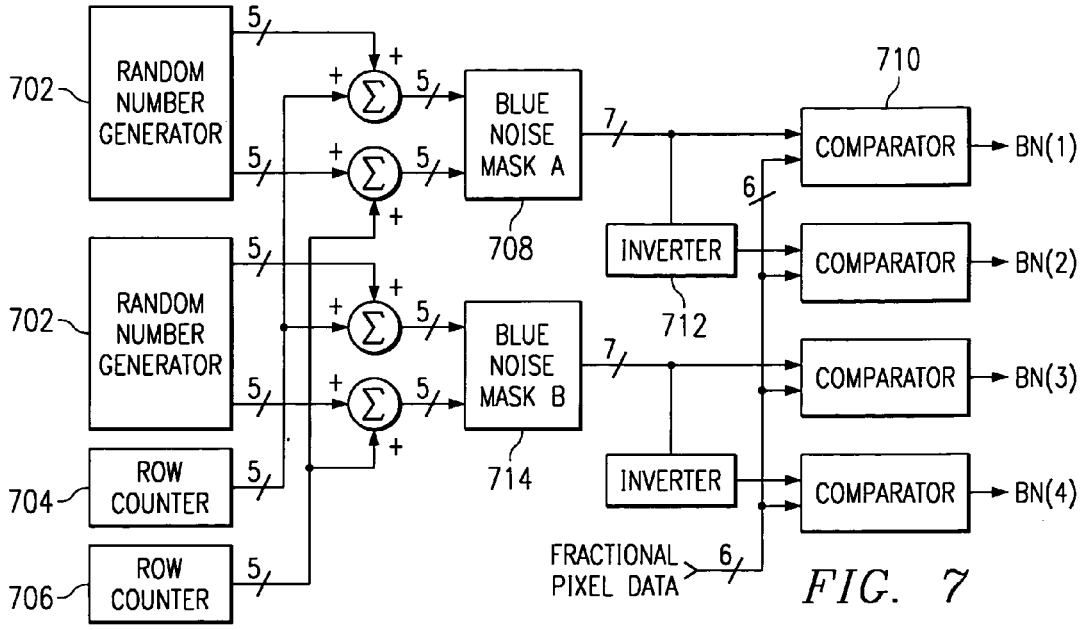
FIG. 7 is a block diagram of a blue noise masking system using only two mask look up tables.

A new pulse width modulation display method has been developed that greatly reduces the PWM quantization and temporal contouring errors associated with prior PWM display systems while avoiding the extremely small bit periods that are difficult to reproduce with a micromechanical spatial light modulator such as the digital micromirror device. The new method very fine control of fractional display bits—virtually eliminating noticeable quantization contouring—without requiring very short bit display durations. The new method relies on a large multi-level mask to reduce the effective duty cycle of the fractional bits. Preferably the multi-level mask does not have a low-frequency component—clusters of ones or zeros—so that the eye is unable to detect the mask. The mask is altered, by changing the mask values and/or moving the mask relative to the image, at a rate high enough to avoid detection of the mask.

As discussed above, typical PWM display systems individually control the duty cycle of each pixel to form an image. At any given time, each pixel of the display typically can only assume either a full-on or full-off state. Intermediate intensity levels are created by controlling the duty cycle of the pixel during each frame time. Intensity data typically is received as a binary word representing the intensity of a given color for a particular pixel. Modulators such as the digital micromirror device rearrange the data into bit planes. Each bit plane is comprised of one equal weighted bit for each pixel of an image. For example, data for a three color, 24-bit per pixel, 640×480 pixel image is received as a series of 307,200 separate 24 bit words, or perhaps three series of 307,200 separate 8 bit words, and reformatted as a series of 24 640×480 bit arrays or bit planes.

Pulse width modulated displays divide the frame period into a series of binary-weighted bit periods. Each of the bit planes determines the state of the pixel, either full-on or full-off, during the corresponding bit period. Many of the bit periods, in particular the larger bit periods, are divided into one or more periods the sum duration of which is proportional in time to the bit weight. For example, the most significant bit of an 8-bit intensity word controls the pixel for 128/255ths of the total word display period. This total duration may be implemented by dividing the MSB period into 8 periods, each 16/255ths of the total word display period.

A single-modulator display system sequentially produces three single color images to provide the perception of a full color image. A three-modulator display system delivers three single color images to the display screen simultaneously to allow the viewer's eye to integrate the images and perceive a full-color image. In a parallel color display system, each single-color intensity work is used during the entire frame period. In a sequential color system, each single-color intensity word is used during roughly one-third of the frame period. Furthermore, to reduce color artifacts, sequential color systems may produces multiple single-color images in a single frame time. For example, a sequential color display system may create red, green, blue, white, red, green, and blue images in a single frame period.

Each intensity data bit may only be displayed during one of multiple single color display periods. For example, the LSB period by only be used during the first of two single color display periods. For simplicity, the following discussion will assume the display is a three modulator parallel display system and will describe the processing that occurs on one of the three color channels. The same processing generally occurs on all three of the channels. Nevertheless, the concepts discussed may be applied to both parallel color and sequential color display systems.

As discussed above, display panels have a minimum response period. This minimum response period is the time it takes each pixel element of the display panel to switch from on to off. For a micromirror device, the minimum response period is the time it takes to reset and deflect a mirror. For an LED array the minimum response period is the time it takes to turn the LED on or off. The time it takes to load the display panel with new data may be considered the practical minimum response time since even though the panel will operate faster, there may not be any practical use for operating the display panel faster than the data load rate. In a simple PWM display, the minimum response period determines the number of gray levels the display system can created during a given frame period. For a high brightness parallel color micromirror display system, the practical limit of simple binary bit periods at a 24 Hz data input frame rate (96 Hz display frame rate) is approximately 9 bits.

FIG. 2 is a plot of the predicted number of bits required to avoid noticeable PWM contouring. Cinema-quality digital projectors have contrast ratios in the 1000 to 2000 range. From FIG. 2 it is seen that a high brightness projector would require between 14.5 and 15 bits of intensity resolution to prevent noticeable PWM contouring—well beyond the limit of most modulators.

One method used to create smaller bit periods is spatial temporal multiplexing (STM). Spatial temporal multiplexing, illustrated in FIG. 2, uses a checkerboard mask pattern to enable a subset of the pixels during each STM bit period. In FIG. 2, array 200 is a 5×5 portion of a bit plane. The bit plane shown has an intensity value of 0.5 LSB. The bit plane has an active bit set for each pixel in each of the three left-most columns and an inactive bit set for each pixel in each of the two right-most columns. In the top portion of FIG. 2, a first mask 202 has a 50% checkerboard pattern. The bit plane 200 and the first mask 202 are ANDed together to determine the data 204 that will be displayed for a first bit plane period.

During a second display period, perhaps later in the frame or during a second frame, a second mask 206 is ANDed with the same bit plane—which, if the second AND operation takes place during a subsequent frame may be different data than used in the first AND operation. The result 208 of the second AND operation is displayed during the second display period. The viewer's eye integrates the two displays, assuming they are both displayed within the integration time of the eye, and perceives the intensities shown in array 210. As shown in array 210, the viewer will perceive the left three columns having an intensity of 0.5 LSB as intended.

While spatial temporal multiplexing works well in many situations, it introduces visible artifacts in some images. Furthermore, spatial temporal multiplexing is limited to the bit intensities it can produce. A 50% checkerboard works well, but other patterns may create visible artifacts in the displayed image. Additionally, creating just a few additional intensity levels using spatial temporal multiplexing may require three additional bit planes. In addition to consuming time that is already in short supply, very small spatial temporal multiplexed bits, such as those created using a 12.5% mask, create noisy images and require extremely short bit periods.

Extremely short bit periods may be implemented on micromirror-based displays using a technique known as "reset and release." The reset and release technique loads data into the micromirror array and resets the mirrors. A bias voltage is then applied to drive the mirrors to the position indicated by the data loaded into the modulator. Then, before the mirror position is stable enough to permit loading new image data to the array, the mirrors are reset a second time. After the second reset period no bias is applied so the mirrors rotate to the flat state. Because the flat state mirrors are not locking in a position against a landing electrode, electrostatic fields from nearby mirror groups affects the position of the flat state mirror. Since the mirror is not rotated to the off position, but is in the neutral flat position slight tilting of the flat state mirrors introduces light into the projection aperture and creates visible artifacts in the image being displayed.

A solution is to use a multilevel mask to convert several bits of data into a single bi-level image. The density of the bi-level image is related to the intensity indicated by the data bits converted by the mask. Using this technique allows 6 data bits to be converted to a single bi-level image that, over a very brief time, produces the 64 gray levels indicated by the 6 bits of data. Coupled with 9 real image bits, a display system is able to produce a 15 bit image using only 10 bit planes.

If the mask used to create the new bi-level bit plane is properly constructed and altered at a high enough rate, the bi-level bit pattern created—which will be referred to as a blue noise bit for reasons that will become obvious shortly—cannot be resolved, temporally or spatially, by the viewer.

The mask used to create a bi-level pattern is three dimensional in that each cell of the array contains a threshold intensity value. FIG. 3 illustrates one example of a three dimensional mask 300. The mask 300 is defined for an array of pixels, in this case a 4×4 array, and is tiled or replicated over the entire image. Each cell of the mask array contains the threshold value. The use of a threshold value allows a single mask to be used on multi-bit data values. The threshold value represents the threshold intensity value necessary to turn on the corresponding pixel. For purposes of illustration and not for purposes of limitation, if the intensity value is a "3," pixels having an intensity of greater than 3 will be displayed. Of course, alternative embodiments can be constructed that enable pixels having intensities greater than and equal to the threshold value, or will enable pixels having intensities less than the threshold value, etc. The discussion of the invention and the appended claims is intended to include all of these alternatives as they are readily apparent to the artisan.

FIG. 4 illustrates the use of the mask 300 of FIG. 3. An input data array 402 holds data for 64 pixels of an image. The input data in each cell of the array is represented by four binary bits and takes on a value between 0 and 15. The particular data shown in FIG. 4 represents a ramp image that decreases from the left to the right. The mask 300 of FIG. 3 is replicated four times and compared to the data in array 402. The result—a "1" when the value in array 402 exceeds the threshold value of the mask 300 and a "0" when it does not—is shown in the array of FIG. 4. The resulting one-bit array 404 clearly shows the tendency of the decreasing ramp from array 402. The viewer's eye typically is unable to resolve adjacent pixels and integrates the values of nearby pixels to smooth the ramp. Repeating this operation while altering the alignment of the mask 300 and the input array 402 further smoothes the data ramp.

The selection of a 4×4 matrix is for purposes of illustration only. In practice, the mask typically is much larger. The larger the mask, the less likely there are to be unintended patterns created by tiling the mask across the display, but the more memory that is required to store the mask. In practice, a 32×32 pixel mask provides a good tradeoff between memory and artifact avoidance.

A 32×32 mask contains cells for 1024 pixels. Each of these pixels may have a unique data value. Therefore, a single mask array may be used to process a 10-bit binary number and arrive at a single display bit. Alternatively, a smaller number of discrete threshold levels may be used in situations in which the precision of 10 bits is not required. For example, a 6-bit threshold value in each cell of the mask provides 64 threshold levels. As the mask is used to process an increasing series of flat fields—that is, pixel arrays having the same intensity value—16 additional pixels of the 1024 pixels controlled by the mask will be enabled each time the intensity value of the flat field crosses another threshold.

As mentioned above, a particularly good mask has the property of "blue" noise. This property states that the noise frequency characteristics contain no low frequency components—that is, no clumping of ones or zeros. Larger masks reduce the tendency to create patterns by replicating the mask improve the bi-level masking process and limit the introduction of screening artifacts.

Temporal artifacts are avoided by using a number of masks that are each periodically shifted relative to the image array. When using multiple masks, care must be taken to ensure that the series of masks does not create image artifacts by having clusters of ones or zeros appear in the same pixel over time—in other words, the multiple mask ideally are "blue" with respect to each other. One method of achieving jointly-blue mask patterns is simply to invert the blue noise mask pattern. The inverted mask may be created by subtracting each threshold value from the maximum threshold value.

Mask inversion causes the cell with the highest threshold in the first mask to become the cell with the lowest threshold in the second mask. This mask inversion ensures that for any intensity level, a minority pixel in the first mask is not a minority pixel in the second mask. Stated another way, for intensity levels low enough to enable less than half of the mask cells of a first mask, none of the enabled cells will be enabled using the inverted mask. Furthermore, for intensity levels high enough to enable more than half of the mask cells in the first mask, none of the remaining disabled cells will be disabled using the inverted mask.

High brightness three modulator display systems often replicate each frame multiple times during a frame period to avoid temporal artifacts. When receiving an input signal having a fairly low frame rate, for example sources originally recorded on film at 24 Hz, the frame typically is displayed at a 96 Hz rate. FIG. 5 is a timeline showing how a 24 Hz frame is may be displayed at a 96 Hz rate and replicated four times to fill the 24 Hz frame period. Each 96 Hz sub-frame is comprised of display periods for each of the integer bits followed by a display period for each of the masked bits, or blue noise bits. Because there are four blue noise bit periods in each frame, four blue noise masks can easily be used to create the frame and avoid the introduction of temporal defects.

FIG. 6 is a block diagram of one implementation of the blue noise dithering process described above that is particularly useful in the quad-frame rate cinema application shown in FIG. 5. In FIG. 6, a mask translation address generator 602 creates an index that will be used to address the blue noise masks. The address generator 602 receives the pixel clock to allow it to increment the address each pixel, and the horizontal and vertical synchronization signals to communicate when a new frame and new row begin. Other signals may be used to index the masks. For example, row and column counters may be used instead of the signals shown in FIG. 6, or a random number generator may be used to randomize the initial offset into the mask.

The output of the address generator 602 is driven to each of four blue noise masks 604. Since a blue noise mask and it's inverted form are jointly blue, only two unique masks and their inverted forms are necessary. Typically the address generator 602 separately creates two independent addresses, one for each mask pair. The threshold stored in the cell indicated by the address is driven to a comparator 606 where it is compared to the fractional bits for a particular pixel. The integer bits, those bits assigned their own bit plane, and the single bit output from each comparator are used to form one of the sub-frames shown in FIG. 5.

One benefit of the system represented by FIG. 6 is the parallel nature of the blue noise operation. Since four masks are used, all four of the blue noise bits are determined simultaneously. This simplifies the circuitry or software needed to implement the blue noise masking process. The drawback is that four separate blue noise masks are required to implement the system of FIG. 6.

An alternative system is shown in FIG. 7. In FIG. 7 the outputs of two random number generators 702 are combined with the outputs of a row counter 704 and column counter 706 to yield row and column indexes into two 32×32 cell blue noise masks. The row and column indexes select a blue noise mask threshold for a given pixel. The threshold from the first blue noise mask 708 is applied to a comparator 710 where it is compared to the fractional bit portion of the pixel data. A first blue noise bit, BN(1), is generated based on this comparison. Typically, BN(1) is a "1" when the fractional portion of the pixel data exceeds the threshold value from the mask.

The same threshold data is also processed by inverter 712 to produce the threshold that would be shored in an inverted form of Mask A. Inverter 712 prevents the circuitry from having to store four separate blue noise masks. As described above, the inverter subtracts the current threshold from the maximum threshold value stored in the mask. The output of the inverter 712 is also compared to the fractional pixel data to produce a second blue noise bit, BN(2). In the same manner, the second blue noise mask 714 is used to generate two additional blue noise bits. The four blue noise bits are then used alternately in the quad-frame display of FIG. 5 with the integer portion of the pixel data.

The multi-threshold mask described above provides the ability to use fractional bits efficiently to achieve virtually any intermediate intensity level with a limited number of bit planes. Since the intensity easily is varied by selecting the various thresholds of the mask matrix, the duration of the blue noise bit planes may be assigned an arbitrary value in terms of an LSB. An alternative embodiment of the present invention exploits this property to achieve a wide range of gray levels without resorting to unreasonably short bit durations.

The use of a 32×32 pixel blue noise mask provides many more cells than are necessary to generate the desired number of fractional bit planes. One embodiment of the present invention limits the fractional bit data values to half the range of the thresholds stored in the blue noise mask. This ensures no more than half of the corresponding pixels are ever enabled. At the same time, the duration of the blue noise bit plane is doubled compared to that duration of the smallest real, or integer, bit. Doubling the length of the blue noise bit plane eliminates the need for extremely short bit planes such as those that require the use of reset and release techniques. The effect of limiting the density of the mask to no more than 50% and the effect of doubling the duration of the blue noise mask offset yet further ensure the two masks are jointly blue.

Figure 8:
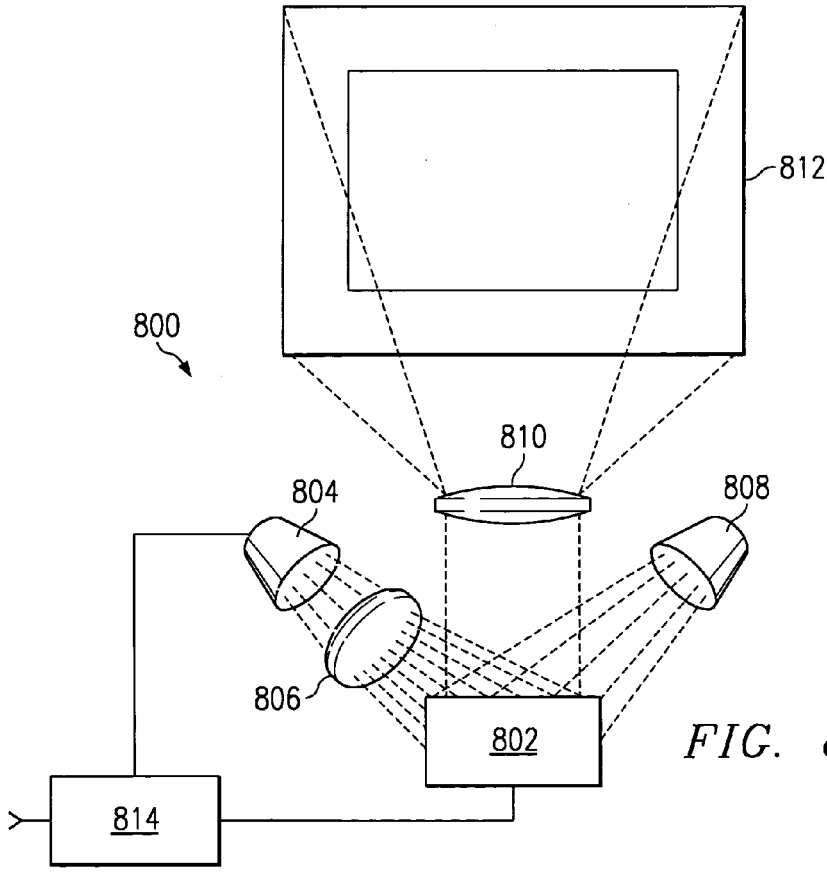
FIG. 8 is a schematic view of a micromirror-based projection system utilizing the multi-level masking of one embodiment of the present invention.

FIG. 8 is a schematic view of an image projection system 800 using the blue noise masking described above. In FIG. 8, light from light source 804 is focused on a micromirror 802 by lens 806. Although shown as a single lens, lens 806 is typically a group of lenses and mirrors which together focus and direct light from the light source 804 onto the surface of the micromirror device 802. Image data and control signals from controller 814 cause some mirrors to rotate to an on position and others to rotate to an off position. Mirrors on the micromirror device that are rotated to an off position reflect light to a light trap 808 while mirrors rotated to an on position reflect light to projection lens 810, which is shown as a single lens for simplicity. Projection lens 810 focuses the light modulated by the micromirror device 802 onto an image plane or screen 812.

Thus, although there has been disclosed to this point a particular embodiment for spatial temporal multiplexing using multi-level threshold masks and a method therefore, it is not intended that such specific references be considered as limitations upon the scope of this invention except insofar as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims. In the following claims, only elements denoted by the words "means for" are intended to be interpreted as means plus function claims under 35 U.S.C. § 112, paragraph six.

What is claimed is:

1. A method of producing an image, the method comprising:

receiving an image data word at a first frame rate, said image data word comprising image data bits for a portion of said image;

selecting at least a first and a second threshold data value for said portion of said image;

comparing a first portion of said image data word with said first threshold data value;

comparing said first portion of said image data word with said second threshold data value;

displaying a second portion of said image data word at a frame rate at least two times said first frame rate;

displaying image data based on said comparing with said first threshold step at a frame rate at least equal to said first frame rate; and displaying image data based on said comparing with said second threshold step at a frame rate at least equal to said first frame rate.

2. The method of claim 1, wherein a three dimensional mask is used to select said threshold data values.

3. The method of claim 1, wherein a different three dimensional mask is used to select each threshold data value.

4. The method of claim 1, wherein at least two three dimensional masks are used to select each threshold data value.

5. The method of claim 4, wherein said at least two three dimensional masks are complimentary.

6. A method of producing an image, the method comprising:

receiving an image data word during a frame period, said image data word comprising image data bits for a portion of said image;

selecting at least two threshold data values for said portion of said image;

comparing a first portion of said image data word with said at least two threshold data values;

displaying a second portion of said image data word at least two times during a display frame period;

displaying image data based on said comparing with a first threshold data value step during said display frame period; and displaying image data based on said comparing with a second threshold data value step during said display frame period.

7. The method of claim 6, wherein a three dimensional mask is used to select said threshold data values.

8. The method of claim 6, wherein a different three dimensional mask is used to select each threshold data value.

9. The method of claim 6, wherein at least two three dimensional masks are used to select each threshold data value.

10. The method of claim 9, wherein said at least two three dimensional masks are complimentary.

* * * * *

UNITED STATES PATENT AND TRADEMARK OFFICE

CERTIFICATE OF CORRECTION

PATENT NO. : 7,576,759 B2
APPLICATION NO. : 10/914915
DATED : August 18, 2009
INVENTOR(S) : Pettitt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1347 days.

Signed and Sealed this

Seventh Day of September, 2010

David J. Kappos

David J. Kappos
*Director of the United States Patent and Trademark Office*